US008646764B2

(12) United States Patent
Barlier et al.

(10) Patent No.: US 8,646,764 B2
(45) Date of Patent: Feb. 11, 2014

(54) NEGATIVE PRESSURE CLAMP WITH FLEXIBLE WORKING PLATE MAINTAINED BY LUGS

(75) Inventors: Claude Barlier, Coinches (FR); Thibaut Jannot, Villers les Nancy (FR); Rudy Michel, Coinches (FR); Romain Siegel, Barcelone (FR)

(73) Assignee: Cirtes SRC, Saint Die des Vosges (FR)

( * ) Notice: Subject to any disclaimer, the term of this patent is extended or adjusted under 35 U.S.C. 154(b) by 660 days.

(21) Appl. No.: 12/674,657

(22) PCT Filed: Aug. 28, 2008

(86) PCT No.: PCT/FR2008/051538

§ 371 (c)(1),
(2), (4) Date: Feb. 22, 2011

(87) PCT Pub. No.: WO2009/030861

PCT Pub. Date: Mar. 12, 2009

(65) Prior Publication Data

US 2011/0169206 A1 Jul. 14, 2011

(30) Foreign Application Priority Data

Aug. 29, 2007 (FR) ..... 07 57232

(51) Int. Cl.
*B25B 11/00* (2006.01)
*B25B 1/00* (2006.01)

(52) U.S. Cl.
USPC ..... 269/21; 269/20; 269/900

(58) Field of Classification Search
USPC ..... 269/21, 20, 900
See application file for complete search history.

(56) References Cited

U.S. PATENT DOCUMENTS

| | | | | |
|---|---|---|---|---|
| 3,765,289 | A * | 10/1973 | Gerber et al. | 83/452 |
| 3,865,359 | A * | 2/1975 | Caroli | 269/21 |
| 4,221,356 | A | 9/1980 | Fortune | |
| 5,035,409 | A * | 7/1991 | Mulliner | 269/21 |
| 5,177,857 | A * | 1/1993 | Ito | 29/559 |
| 5,675,403 | A | 10/1997 | Cerrina et al. | |
| 6,405,437 | B1 * | 6/2002 | Sussmilch et al. | 29/890.08 |
| 7,006,201 | B2 * | 2/2006 | Uemura | 355/73 |

FOREIGN PATENT DOCUMENTS

| | | |
|---|---|---|
| DE | 9204704 | 6/1992 |
| SU | 650776 | 3/1979 |
| WO | 8304384 | 12/1983 |

* cited by examiner

*Primary Examiner* — Lee D Wilson
*Assistant Examiner* — Nirvana Deonauth
(74) *Attorney, Agent, or Firm* — Egbert Law Offices, PLLC

(57) ABSTRACT

The invention relates to a negative pressure clamp that includes a bearing plate including a plurality of chambers into each of which gives a suction duct, said working plate being covered with a flexible and formable working plate having suction openings formed therein for drawing a part to be maintained and perforations in which are inserted the lugs of the bearing plate arranged about the chambers.

9 Claims, 3 Drawing Sheets

NEGATIVE PRESSURE CLAMP WITH FLEXIBLE WORKING PLATE MAINTAINED BY LUGS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates mainly to the field of the holding of machining workpieces on work tables, and in particular, to the field of negative pressure clamps.

2. Description of Related Art Including Information Disclosed Under 37 CFR 1.97 and 37 CFR 1.98.

During machining, assembly or transformation operations on workpieces it is necessary for the workpiece to be firmly fixed to a support. This fixing, commonly known as a clamp, nowadays no longer has jaws and has evolved to allow the shaping of complex and sometimes very large-sized workpieces such as, for example, panels or sheets, made of highly varying materials (wood, metal, polymer, composite, etc).

The clamps required by industry have to meet varying constraints.

In many applications, the workpiece that is to be held has dimensions and shapes that do not remain constant during the holding operation and so the clamp has to allow highly varied machining workpieces to be positioned and held in position, and this also means that the surface via which the workpiece is fixed in the clamp has to deliver a holding force that remains constant whatever the size and geometry of the workpiece, and also that the workpiece has to be identified precisely in a direction perpendicular to the surface of the clamp.

Another known constraint in producing and designing clamps is that the holding operation has to be performed under conditions that are optimal from the point of view of the time needed, either to maneuver the workpiece between two configurations of the clamp, or to switch workpieces between the workpiece already shaped and a workpiece still to be machined, for example on a production, cutting, drilling, grinding, etc. The operation of holding and of releasing the machining workpiece, and the reverse process between positioning the workpiece and immobilizing it, has to be performed in the shortest possible space of time for obvious productivity reasons.

Various known devices described, for example, in patent EP 1 283 760 in the name of the applicant company or patent EP 1 082 196 which discusses a system for the negative pressure fixing of panels for machining by means of pistons, or even document EP 505 668 which describes suction-cup means for immobilizing workpieces, address the following problems inadequately, if at all: the workpiece has to be immobilized and released in the shortest possible space of time; in order to be inserted easily into an automated transformation line, the holding device must not impede access to the machining workpieces; the energy consumption must be minimal; the clamp must be able to hold flat workpieces of varying sizes with complex contours, but must also be able to hold workpieces of complex shape, which are not flat, and in that respect the tools currently available are particularly ill-suited; the clamp must be able to position the machining workpiece accurately.

Just like the negative pressure clamps known from the prior art, the device that addresses the abovementioned problems has also to meet the general constraints on this type of tool, namely satisfactory distribution of the suction pressure across the work surface and optimal shutting-off of the points not covered by the surface that is to be held, while at the same time ensuring that the method operates at low cost.

It is therefore an objective of the invention to address these key difficulties by proposing a new clamp operating on negative pressure suction.

The prior art discloses devices operating by negative pressure suction for holding workpieces or objects.

In documents U.S. Pat. No. 3,335,994 A and U.S. Pat. No. 3,197,170 A, the suction devices are devices with shut-off balls used to shut off or open the outlet of the suction ducts of the cavities situated under a support plate. These devices are complex to implement, with numerous components that have to be assembled and difficulties in achieving a reliable seal between the balls and the workpiece support plate.

Document DE 3 140 882 A discusses a suction device the suction cavities of which each open via several orifices in a support plate, it being possible for said orifices to be shut off by deformable lamellae. This device has the same disadvantages as the previous ones.

In order to obviate the difficulties of operation of devices with shut-off balls or lamellae, the applicant company has leaned toward a solution that employs a flexible membrane by way of shut-off means.

The prior art cites patent U.S. Pat. No. 4,221,356 A which describes a suction-cup device configured for holding workpieces and not for the precise holding that machining entails. However, the suction cup described certainly presents a problem of operation because, as it deforms, it may come into contact with the bottom of the suction chamber, leading to a risk of canceling the suction force and causing the workpiece to fall.

The prior art also discloses another device discussed in document DE 92 04 704 U1 and which employs a flexible membrane by way of a means of shutting off the suction ducts that open into chambers situated under said membrane.

BRIEF SUMMARY OF THE INVENTION

When holding a workpiece, the underside of which may be planar or non-planar, the membrane may become squashed at various zones of the supporting surface. The stability of the workpiece and its accurate positioning in a direction perpendicular to the support surface can therefore not be guaranteed.

This problem is addressed by the invention which proposes a holding device with flexible membrane which guarantees the stability of the workpiece and its accurate positioning in a frame of reference (Ox Oy Oz) in which (Ox and Oy) are defined by the support surface and (Oz) is a reference orthogonal to this surface.

The invention includes a clamp connected to a suction device so as to use a negative pressure to press a workpiece that is to be held firmly against a work surface and immobilize it, said clamp having a work plate in contact with the workpiece that is to be immobilized and a support plate in contact with said work plate, and in which clamp: the work plate is pierced with orifices, each orifice being in communication with an underlying chamber; the support plate comprises a collection of chambers, each chamber being in communication with the suction device via a duct; a shut-off means that can be moved by the effect of the negative pressure is present in each chamber so as to close off the duct when there is no workpiece that needs to be held positioned at the mouth of an orifice on the work surface; wherein the shut-off means is produced in the form of a flexible and deformable work plate pierced with orifices, an orifice not being axially aligned with a duct of the underlying chamber so that a non-perforated zone of the work plate deforms under the effect of a negative pressure in an underlying chamber when there is no workpiece to be held positioned at the mouth of the orifice corresponding to this chamber, and wherein the work plate is held at the periphery of each chamber by a plurality of lugs of the support plate fitting into perforations of the work plate, said lugs creating a reference surface for the positioning of the workpiece that is to be held.

For preference, said lugs can be removed and replaced should they become worn or suffer damage through a machining accident.

The clamp according to the invention has many advantages.

The mechanism for holding and releasing the workpiece is very quick, near instantaneous.

The clamp can be used for holding and positioning planar structures such as panels or sheets, for example, but can also be used for immobilizing three-dimensional workpieces and complex shapes, something which is entirely novel and innovative, and this advantage can be exploited notably for the rapid prototyping of components and in the Stratoconception device as developed by the applicant company and described in their patent EP 585 502.

The clamp as described in the invention can easily be inserted into a machining line notably because the structure of the work surface can be smooth, with no moving parts, unlike the known holding devices which make recourse to valves, suction cups or pistons.

An additional advantage is introduced by the possibility that the work plate of the clamp can be fitted with, or itself constitute, a work surface tailored to the machining workpiece, so that the tool can operate just as easily with flat machining workpieces as it can with textured or three-dimensional workpieces, something which cannot be achieved in the known clamps.

Quite obviously, the clamp according to the invention provides effective shutting-off of the suction points not covered by the surface that is to be immobilized, thereby avoiding pressure losses detrimental to the operation of the clamp. For good optimization, the system detects and adapts in real time to any potential change in the useful holding surface which may thus evolve in the course of the manufacture of the workpiece without the holding quality being impaired. For example, when machining a workpiece, part of the holding surface may become completely clear of the work surface, thus generating a leak. The system is then able dynamically to self-adapt, closing off the leak caused. This self-adaptation also makes it possible to limit the losses of negative pressure and thus propose low energy consumption.

BRIEF DESCRIPTION OF THE SEVERAL VIEWS OF THE DRAWINGS

Other features and advantages of the invention will become apparent from the description which will follow, with reference to the attached drawings which are given purely by way of non-limiting examples.

DETAILED DESCRIPTION OF THE INVENTION

Figure 2:
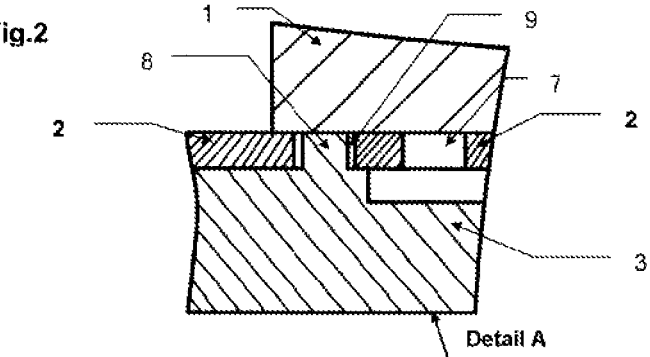
FIG. 2 is an isolated detail view AA of FIG. 1.
Figure 1:
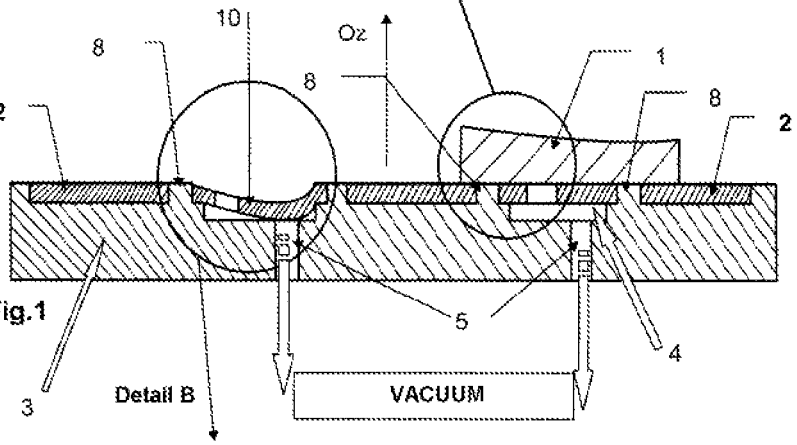
FIG. 1 is a schematic view which sets out the principle of operation of the clamp for a preferred alternative form of the invention in which the work surface is a flexible membrane acting as a shut-off means.
Figure 3:
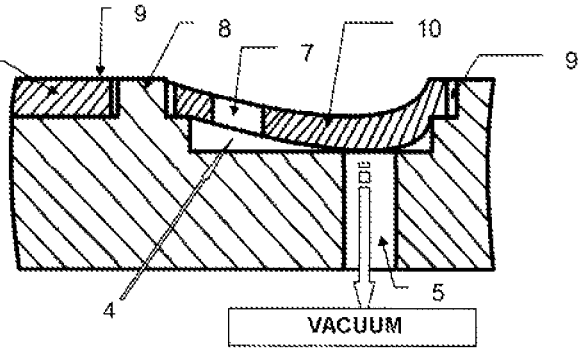
FIG. 3 is an isolated detail view BB of FIG. 1.

The clamp according to the invention is connected to a suction device so that a workpiece (1) is applied firmly using a negative pressure to a work surface and immobilized.

The clamp in its general form comprises at least one support plate (3) backing onto a work plate (2). Within the meaning of the invention, the work surface is represented at the interface between the workpiece that is to be held and the work plate.

The support plate (3) comprises a collection of chambers, each chamber (4) being in communication with a suction device via a duct (5), which duct passes through the support plate (3) and is connected to a negative pressure-generating device, for example a negative pressure pump. A duct (5) as described in the invention may have any shape, that is to say may be of square, oval or irregular cross section, although the cross section is preferably round, and the duct is therefore of cylindrical shape.

The work plate (2) in contact with the workpiece that is to be held, is pierced with orifices (7), said orifices being in communication with underlying chambers (4) connected to the suction device, so that the negative pressure generated by the suction device is applied to the work surface, under the workpiece that is to be held, via the suction duct and then said orifices.

In order to close off the orifices (7) that are not covered by the workpiece that is to be held, that is to say in order to close off the suction duct when there is no workpiece positioned at the mouth of the orifice or orifices on the work surface, the work plate is a thin plate (2) made of a material that can be deformed under the effect of a negative pressure on one side of said thin plate and able through elasticity to revert to its initial shape in the absence of a pressure difference across the two sides of the sheet.

For preference, but without implying limitation, the plate (2) is a sheet of material made of flexible material, for example a polymer sheet.

For preference, the plate (2) has a thickness of between 0.1 mm and 5 mm, and is made in one or more parts.

The plate (2) is pierced with orifices (7), the orifices (7) not being axially aligned with the ducts (5) so that a non-perforated zone (10) of the work plate deforms under the effect of a negative pressure in the underlying chamber (4) when there is no workpiece that has to be held positioned at the mouth of the orifice (7) corresponding to this chamber.

The plate (2) is held at the periphery of each chamber (4) by a plurality of lugs (8) of the support plate (3), fitting into perforations (9) of the work plate (2), said lugs achieving contact between the support plate (3) and the workpiece that is to be held (1), thus providing a reference for the positioning thereof.

The figures show that, when the negative pressure is instigated, the workpiece that is to be held (1) presses down on the lugs (8) surrounding a chamber (4) and the zone (10) positioned above this chamber does not deform, whereas the zones (10) situated above chambers that are not covered by the workpiece (1) deform and shut off the ducts (7) situated under said zones (10) which deform.

The deformable sheet acts as a shut-off and sealing means around the chamber or chambers (4) situated under the workpiece.

The upper surfaces of the lugs (8) which are in contact with the underside of the workpiece form a reference surface for the accurate positioning of the workpiece along an axis Oz perpendicular to the work plate (2).

Without departing from the scope of the invention, it is, for example, conceivable for the chamber (4) to have varying sizes and shapes, for there to be a greater or lesser number of orifices (7) transmitting the negative pressure to the work surface, etc.

Figure 4:
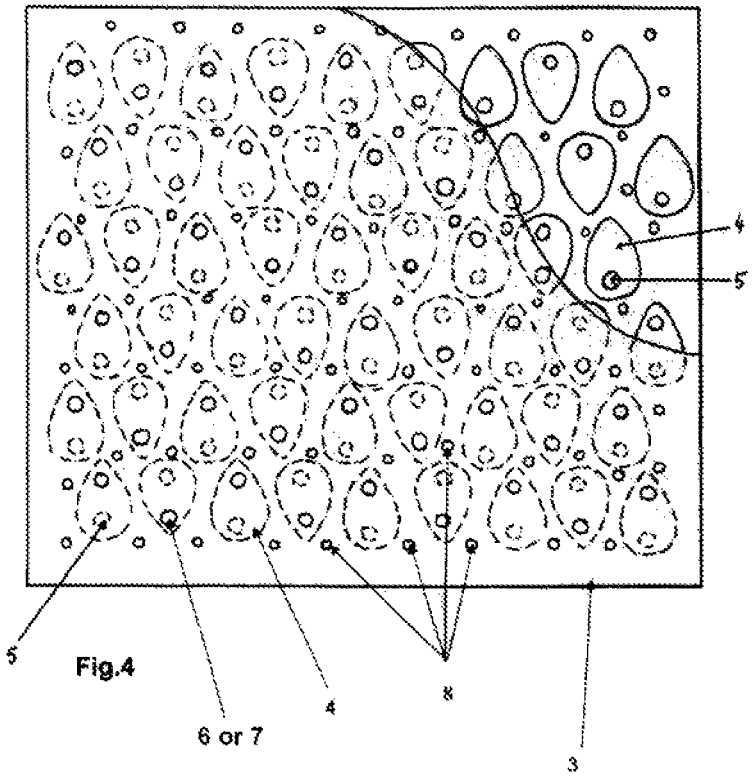
FIG. 4 is a plan view of a clamp (3) showing one example of shape and layout of the chambers of the support plate to optimize the useful holding surface of a clamp according to the invention, a sheet 2 being placed on the support plate.

The preferred and non-limiting shape of the chambers (4) as depicted in FIG. 4 makes it possible to increase the number of suction points for the same surface area.

This shape has been specially declamped in order to obtain the shortest possible distance between two suction points.

The system works thanks to two holes: a suction hole which is the perforation (7) in the membrane, and a negative pressure hole which is the mouth of the duct (5). When the suction hole is not obstructed by a workpiece that is to be held, it is the negative pressure hole that will become obstructed in order to prevent losses of suction.

To achieve this, the negative pressure hole has to suck the flexible membrane until it is hermetically and firmly applied to its perimeter. This operation is governed by the behavior of the material and notably by its pressing radius. This radius is governed by a physical law that dictates the deformation of the material and is a function of the elastic properties of the material, the thickness thereof, and also of the geometry of the chamber and of the level of negative pressure. Thus, in order to be able to suck the membrane and provide airtight closure, the mouth of the duct (5) has (for a negative pressure of between 0.95 and 1 bar and a material thickness of 1.5 mm) to be placed at the center of a theoretical free cylinder with a radius of 10 to 14 mm and a height of 0.8 to 1.1 mm, which free cylinder defines the minimum radius of chamber to be provided around the mouth of the duct (5).

On the basis of this analysis and of these dimensions, the shapes of suction chamber that offer the best ratio between optimizing the suction area and ease of manufacture, are ovoid shapes with a pointy end or with a radius of curvature that is shorter than the radius of curvature of the other end, reminiscent of the shapes of "eggs" or "teardrops".

Figure 5A:
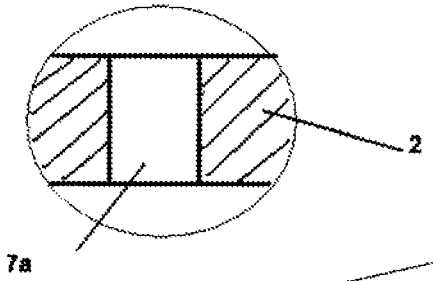
FIGS. 5*a* and 5*b* are schematic views of outline diagrams of two alternative forms, enlarged and viewed in cross section, of the suction orifices (7) of a work plate.
Figure 5B:
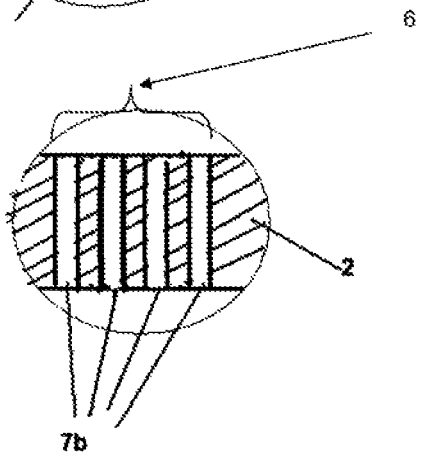

Advantageously, as in FIG. 5, the mouth of the duct (5) is positioned in the widest part of the chamber whereas this chamber may be not so wide on the underside of the orifice (7). This distribution makes it possible to reduce the size of each chamber and generate a chamber shape that can naturally be organized into a staggered configuration over all or part of the support plate (3), this making it possible to reduce still further the distance between two suction points. More specifically in FIG. 4, the chambers in one and the same row are placed side by side with the less wide part alternately on one side and the other of the direction of the row, and the chambers of one row are offset in relation to those of the next and/or previous row.

Preferably and nonlimitingly, the lugs may be removable or capable of being dismantled, for example using screw means. This arrangement is particularly advantageous because it allows the height of the lugs to be adjusted, particularly when the work surface is a skew surface and/or allows these lugs to be replaced in the event of wear or machining damage.

Likewise, it is possible to conceive of two alternative forms of embodiment for an orifice (7), either a single hole (7*a*) or a surface element (6) perforated with a plurality of perforations or microperforations (7*b*), this alternative form acting as a flow accelerator and as a filter to block out chips and other machining residue and prevent it from entering the underlying chamber.

In the clamp according to the invention, there are no moving parts dependent on gravity and this makes it possible to increase the holding options, and notably allows the clamp to be used with a work surface standing vertically or in an oblique position, for example for robotics applications. The workpiece may even remain held if the suction is cut off.

The size of the clamp, the thickness of the various plates, the strength of the negative pressure and the various dimensional parameters may be adjusted within a broad range without departing from the scope of the invention.

Various applications of the invention have been cited, such as the holding of workpieces for machining and use in Stratoconception, but the clamp according to the invention may equally be used as a pneumatic valve or for grasping an object, for example at the end of a robotized arm or on a conveyor line.

Of course, the invention is not restricted to the embodiments described and depicted by way of examples but also encompasses all technical equivalents and combinations thereof.

We claim:

1. A clamping apparatus for immobilizing a workpiece, the clamping apparatus comprising:

a support plate having a plurality of chambers formed adjacent a surface thereof, said support plate having a plurality of ducts extending therethrough and in communication respectively with said plurality of chambers, said support plate having a plurality of lugs extending outwardly of said surface at a periphery of the chamber;

a work plate positioned adjacent said surface of said support plate, said work plate having at least one orifice extending therethrough so as to be in communication with a chamber of said plurality of chambers that underlies said work plate, said work plate suitable for contact with a surface of the workpiece, said work plate being flexible and deformable, said work plate having a plurality of perforations respectively receiving said plurality of lugs so as to fixedly position said work plate over the chamber, said lugs suitable for creating a reference surface for positioning of the workpiece; and a suction device communicating with the chamber through the duct, said suction device for providing a vacuum into the chamber such that the at least one orifice in contact with the workpiece is secured to said work plate, the at least one orifice being not axially aligned with the duct, said suction device for deforming said work plate such that a non-perforated portion of said work plate bears against a mouth of the duct in the chamber so as to shut off the vacuum when the workpiece is not positioned over the at least one orifice.

2. The clamping apparatus of claim 1, said work plate being a perforated polymeric sheet.

3. The clamping apparatus of claim 1, said plurality of lugs being removably affixed to said support plate.

4. The clamping apparatus of claim 1, each of said plurality of chambers having an ovoid shape.

5. The clamping apparatus of claim 4, each of said plurality of chambers having one end that is wider than an opposite end thereof.

6. The clamping apparatus of claim 5, said mouth of said duct positioned adjacent the wider end of the chamber.

7. The clamping apparatus of claim 4, said plurality of chambers arranged in a staggered pattern over at least a portion of the surface of said support plate.

8. The clamping apparatus of claim 1, said at least one orifice comprising a single orifice formed through said work plate.

9. The clamping apparatus of claim 1, said at least one orifice comprising a plurality of microperforations.

* * * * *